United States Patent [19]

Gipson

[11] Patent Number: 4,646,914

[45] Date of Patent: Mar. 3, 1987

[54] SEALED ENCLOSURE FOR DISPLAY OBJECTS

[76] Inventor: Jerome Gipson, 5748 Berkeley St., Vancouver, British Columbia, Canada

[21] Appl. No.: 757,297

[22] Filed: Jul. 22, 1985

[51] Int. Cl.[4] ..... B65D 85/48; B65D 81/26

[52] U.S. Cl. ..... 206/45.34; 206/414; 206/204; 206/524.4; 206/524.8

[58] Field of Search ..... 206/454, 204, 524.4, 206/524.8, 45.34

[56] References Cited

U.S. PATENT DOCUMENTS

| | | | |
|---|---|---|---|
| 3,695,416 | 10/1972 | Klauer et al. | 206/45.34 |
| 3,943,987 | 3/1976 | Rossi | 206/524.8 |
| 4,062,449 | 12/1977 | Popkes et al. | 206/45.34 |
| 4,091,919 | 5/1978 | MacLeod et al. | 206/524.8 |
| 4,275,810 | 6/1981 | Waldmeier | 206/45.34 |
| 4,402,399 | 9/1983 | Friess | 206/45.34 |
| 4,548,824 | 10/1985 | Mitchell et al. | 206/524.8 |

*Primary Examiner*—Joseph Man-Fu Moy
*Attorney, Agent, or Firm*—David J. French

[57] ABSTRACT

An enclosure and mount for display of objects, including works of art which are flat and thin or relief works having depth, comprises a front plastic covering, mat board, mounting board, plastic foam backing with desiccant disc therein and final outside backing. The object to be protected is mounted therein and the perimeter is sealed by pressure-activated film tape after injecting inert gas which replaces the air inside. A moisture indicator sealed within can be viewed through a window.

4 Claims, 3 Drawing Figures

SEALED ENCLOSURE FOR DISPLAY OBJECTS

FIELD OF THE INVENTION

This invention relates to a method of sealing objects within a hermetically sealed enclosure. More particularly, it relates to a framing structure for art objects that excludes moisture and provides means for detecting the entry of moisture, if such should occur.

BACKGROUND OF THE INVENTION

Efforts have been previously made to enclose art and other objects for display in a hermetically sealed chamber that contains an inert or moisture reduced gas. Examples are shown in U.S. Pat. Nos. 3,292,339 and 4,183,160.

Methods which use silicon glues and other sealants based on highly volatile solvents have the disadvantage that such solvent vapours remain in the enclosure. Such sealants also require time to cure.

While it is known to provide a desiccant within containers to reduce and absorb the humidity, the relatively thin and planar dimensions of conventional framing structures are not adapted to permit enclosure of significant quantities of desiccant in a way that does not unduly increase weight or increase the thickness of the assembly.

Further, no means has yet been proposed for providing an indication, without opening the container, that the seal in such a chamber has failed to the extent of permitting moisture to enter.

OBJECTS OF THE INVENTION

It is therefore an object of the present invention to provide a hermetically sealed enclosure for containing art and other objects for display in an inert gas which is suitably compact and lightweight to be adapted to framing.

It is a further object of the invention to make provision in such a container for a substantial volume of desiccant and a means for determining when the moisture level has exceeded a predetermined minimum.

SUMMARY OF THE INVENTION

In order to hermetically seal an object in a benign gas for display the display object is enclosed between a transparent, impermeable front plate and a correspondingly shaped and dimensioned impermeable back plate. A benign gas is introduced, displacing air and moisture. The space between the edges of the two plates is then sealed by application of a border of flexible self-adhesive sealing tape having an adhesive which does not readily release volatile components.

In order to provide space for a desiccant, the backing plate may be constituted of a sheet of expanded, hydrocarbon based foam board of substantial thickness. A hole in the thickness of this board may be used as a cavity to receive the dessiccant, and the air-tight seal of the chamber may be maintained by placing sealing tape thereover.

To provide a means for determining if the desiccant has become exhaused or if moisture has accumulated within the chamber to a significant degree, a transparent sealing tape may be applied over a hole in the backing plate and a colour-responsive moisture indicator may be displayed therein.

These and further features of the invention will be apparent from the description of an embodiment of the invention which follows below.

DESCRIPTION OF THE ILLUSTRATED EMBODIMENT

Figure 1:
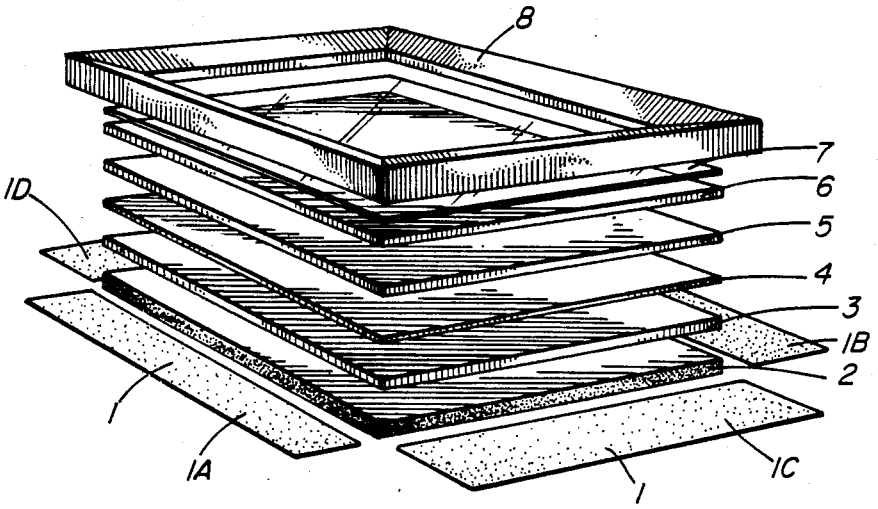
FIG. 1 is an exploded perspective view of a picture-enclosure system prior to assembly.
Figure 2:
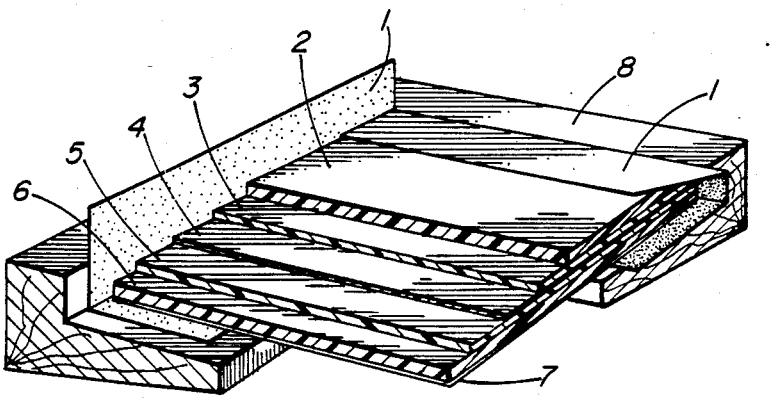
FIG. 2 is a cut-away perspective view of the enclosure system of FIG. 1, after assembly.

Referring to FIG. 1, there is shown a protective front sheet 7 which is impervious to air, gas and fluid. An optional rear sheet (not shown) may also be employed. These plastic sheets may be made of transparent, semi-flexible styrene, polyvinylchloride, polyester, polyethylene, acrylic or other suitable material and are larger in dimensions than corresponding dimensions of display object 4. At least one decorative mat board 6 or spacer 5 may serve to decorate and provide air space between the front protective sheet 7 and display object 4 ensuring no substantial contact between the front protective sheet *7a* and the display object 4. Mounting board 3 having length and width dimensions equal to but not greater than the length and width dimensions of the protective sheet 7 is made of archival quality rag, cotton, alpha pulp, plastic or other archivally correct material having as its object to provide a surface on which display object 4 can be mounted by conventional archival mounting materials or devices and to provide a buffer between display object 4 and foam backing 2. The plastic foam backing board 2 is constructed of a sandwich panel of extruded foam polystyrene with ABS cap sheets having a thickness of 3/16". The backing board 2 may have an approximately 3" diameter hole 9 cut out and wherein a desiccant disc may be inserted and subsequently held in position by a transparent label prior to application of the border of sealing tape 1.

The sealing tape employed should be relatively gas impermeable. In particular, it should be relatively impermeable to the transmission of water vapor. As indicated previously, the adhesive associated therewith should have a minimal tendency to release volatile vapors.

One product that acheives these qualities is metalized, polyester film tape with an acrylic adhesive sold by the 3M Company as No. 850 Scotch Brand tape. This tape is suitable for this application because of its excellent chemical and thermal stability being flexible at −40° C. and dimensionally stable up to 150° C. It is strong and ultra thin (0.05 mm). This tape is placed at the perimeter of protective sheet 7 and backing 2 enclosing the contents therebetween from any outside contamination. At least one layer of tape 1, is applied in overlapping sections, to completely surround the marginal edge of protective sheet 7 and backing board 2 which sandwich the mat board 6, display object 4, and mounting board 3 without the use of clamps or other devices.

While the tape 1 is being applied, the air space inside is purged with a pressurized inert gas such as argon or nitrogen. Any gas having a benign effect on the display object may be employed. Such gas having no more than 10 parts moisture per million, may be blown under approximately 50 lb. psi., into the enclosure after the two longest sections of sealing tape 1*a*, 1*b* have been applied, flushing excess air and other impurities out. A third section of tape 1*c* is then applied and a needle attached to the inert gas supply is used to puncture section 1*c* and flush the contents of the enclosure with gas a second time. This is followed by the application of the final section of tape 1. Then the contents of the enclosure is purged with gas a third time through the puncture made in section 1*c* causing the enclosure to swell. Thereupon the needle is removed and the assembly is compressed between flat smooth sheets of plywood or plastic or other material placed on top and bottom of the enclosure. This causes the surplus gas to be forced out of the puncture hole made in tape segment 1. Once the gas ceases to flow from the hole the enclosure returns to its original shape and the puncture hole is resealed with a further piece of tape 1.

Should one choose to attach information pertaining to the enclosed art object this may be placed on the outside of the foam backing sheet 2 and a second transparent protective sheet 7*b* having length and width dimensions equal to but not greater than the backing sheet 2 is placed thereover. Tape may then be applied to hold this sheet 7*b* in place and, for maximum security, a second layer of tape may be applied all round.

The decorative picture frame 8 shown in the accompanying drawings is made purposely $\frac{1}{8}''$ larger in length, width and depth dimensions than that of the sealed enclosure. It may vary in design, shape, color and composition but serves to hide the tape 1 from view and to protect it from accidental puncture. The frame 8 may be constructed of known materials such as wood, metal, plastic or composition on which a hanging device, such as a hook or wire, may be attached.

Figure 3:
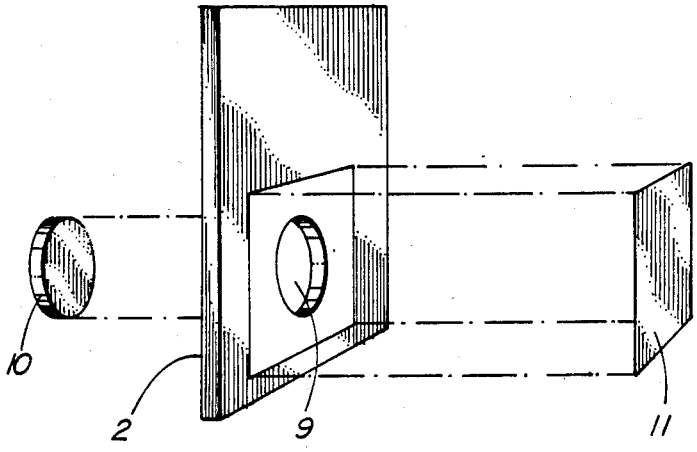
FIG. 3 is a rear view of the assembly incorporating a desiccant disc.

The hole 9 in the backing sheet best shown in FIG. 3 may be filled with a pre-packaged disc 10 containing silica gel, or other suitable desiccant. Because the backing plate 2 has a substantial thickness, a significant amount of desiccant can be accommodated in the hole 9. This prolongs the moisture reducing performance of this substance.

To ensure the seal of the enclosure, tape 11 is applied over this hole 9. If a transparent version of this tape is used, the desiccant may be visibly apparent from outside the enclosure. Silica gel changes from white to a blue when its moisture absorbing capacity is exhausted. This can serve to indicate the moisture condition within the enclosure. Alternately, a separate color sensitive moisture indicator may be contained behind tape viewable from the backing side of the frame.

The foregoing is a description of an illustrated application of the invention. The invention in both its general and particular aspects is set out more particularly in the claims which follow.

What I claim is:

1. A sealed enclosure for display objects comprising:

(a) a gas impermeable rigid, planar protective transparent front sheet;

(b) a gas impermeable rigid, planar protective back sheet of corresponding shape and planar dimensions to said front sheet;

(c) a display object contained between said front and back sheets; and (d) a border of flexible sealing tape applied around the perimeter of said front and back sheets so as to form a hermetically sealed enclosure for containment of said display object, which sealed enclosure is substantially filled with a relatively moisture-free benign gas in the place of the air that would otherwise be present therein wherein said back sheet is of substantial thickness and has a desiccant material in a cavity formed therein, said cavity being sealed from communication with the outside environment and wherein said enclosure contains moisture indicating means which indicating means is sealed from the outside environment by transparent sealing means which permits viewing of said moisture indicating means from outside of the enclosure.

2. An enclosure as in claim 1 in which said back sheet is composed of an expanded light weight foam board.

3. An enclosure as in claim 2 in which said indicating means is a moisture activated color changing desiccant.

4. A method of sealing display objects in an enclosure containing a benign gas comprising the steps of:

(a) containing said display object between rigid, planar front and back protective sheets of corresponding shape and planar dimensions, said back sheet being of substantial thickness and having a desiccant material in a cavity formed therein, said cavity being sealed from communication with the outside environment, moisture indicating means being located within said back sheet and sealed from the outside environment by transparent sealing means which permits viewing of said moisture indicating means from outside of the enclosure;

(b) applying a flexible sealing tape around a portion of the perimeter of said protective sheets;

(c) flushing out the air in said container with a flow of benign gas introduced into the region between said protective sheets through a needle pierced through a hole in said tape;

(d) sealing the remaining perimeter between said protective sheets with tape; and (e) removing said needle and sealing said hole.

* * * * *